US007409973B2

(12) United States Patent
Hyde

(10) Patent No.: US 7,409,973 B2
(45) Date of Patent: Aug. 12, 2008

(54) ROUTER TABLE PLATE ASSEMBLY

(75) Inventor: Brent K. Hyde, Ottawa (CA)

(73) Assignee: Lee Valley Tools Ltd., Ottawa, ON (CA)

( * ) Notice: Subject to any disclaimer, the term of this patent is extended or adjusted under 35 U.S.C. 154(b) by 92 days.

(21) Appl. No.: 11/211,843

(22) Filed: Aug. 25, 2005

(65) Prior Publication Data

US 2006/0086425 A1 Apr. 27, 2006

Related U.S. Application Data

(60) Provisional application No. 60/604,536, filed on Aug. 25, 2004.

(51) Int. Cl.
*B25H 1/02* (2006.01)

(52) U.S. Cl. ..... 144/286.5; 144/286.1

(58) Field of Classification Search ..... 144/136.95, 144/286.1, 286.5; 409/182
See application file for complete search history.

(56) References Cited

U.S. PATENT DOCUMENTS

| | | | | |
|---|---|---|---|---|
| 2,615,479 | A | 10/1952 | Bearup | |
| 2,776,682 | A | 1/1957 | Mullen | |
| 4,335,765 | A | 6/1982 | Murphy | |
| 4,679,606 | A * | 7/1987 | Bassett | 144/135.2 |
| 4,733,704 | A | 3/1988 | Wolff | |
| 5,025,841 | A | 6/1991 | Totten | |
| 5,289,861 | A | 3/1994 | Hedrick | |
| 5,398,740 | A | 3/1995 | Miller | |
| 5,715,880 | A * | 2/1998 | Tucker et al. | 144/286.1 |
| 5,725,038 | A | 3/1998 | Tucker et al. | |
| 6,405,654 | B1 * | 6/2002 | Smith | 102/517 |
| 6,550,154 | B1 * | 4/2003 | Smith | 33/638 |
| 6,739,066 | B2 * | 5/2004 | Smith | 33/638 |
| 6,792,984 | B2 * | 9/2004 | Fontaine | 144/135.2 |
| 6,948,892 | B2 * | 9/2005 | Hummel | 409/182 |
| 7,108,463 | B2 * | 9/2006 | Hummel | 409/182 |
| 2005/0230003 | A1 * | 10/2005 | Radermacher | 144/286.5 |

* cited by examiner

*Primary Examiner*—Shelley Self
(74) *Attorney, Agent, or Firm*—Kilpatrick Stockton LLP; John S. Pratt; Camilla C. Williams

(57) ABSTRACT

A router table assembly including a plate with router mounting clamps, a plate leveling system for securing and positioning the plate in the router table and a plate lift assembly. Components of this system are usable separately. Use of these components together provides a particularly easy to use, highly functional router table apparatus.

2 Claims, 11 Drawing Sheets

ROUTER TABLE PLATE ASSEMBLY

RELATED APPLICATION DATA

This application claims priority to U.S. Application Ser. No. 60/604,536 filed Aug. 25, 2004, which is incorporated herein by this reference.

FIELD OF THE INVENTION

This invention relates to router tables generally and more specifically to router table plates, plate levelers, router to plate mounting structures and plate lifts.

BACKGROUND OF THE INVENTION

Because of their versatility, electric routers are very widely used in woodworking, particularly in home and small commercial shops. Such routers are generally intended to be used by moving the router relative to a stationary work piece with a portion of the router base bearing against the work piece.

Using a router in this manner is suitable if the work piece is substantially larger than the router or is immovable. For smaller work pieces, such as the sizes used in trim work, furniture making or cabinetry, it is often more practical to invert the router such that the cutter is oriented generally upward and move the work piece. As the base of such routers is too small to be used safely in the inverted configuration, a standard practice is to affix the router to the underside of a larger table surface. In addition to addressing the safety concerns, a router table also provides the means for additional functionality as provided through accessories such as a fence, sled or miter gauge.

In order to use a router in such a configuration, it is necessary that the router be affixed to the underside of the table using non-permanent means. Most routers available on the market include a plurality of threaded holes in the base into which standard machine screws may be inserted. These screws can be used to attach the router directly to the router table or to a plate that is then attached to the table in some manner. There is no standard or common hole pattern among router bases, so a router table compatible with the greatest number of routers will require numerous extra holes in addition to those actually used to affix the router. These holes can interfere with use of the router table.

The base of many routers includes a pair of fence mounting holes whose axes are parallel to each other but normal to that of the router cutter. Although these holes can be used for mounting the router in a router table, there are shortcomings. Not all routers have such fence mounting holes. The spacing of such holes is more consistent than the base holes but still is not universal. Furthermore, because any clamping device would need to penetrate into the holes, the router cannot be quickly removed for other jobs and reattached in the same location.

Due to the versatility and control that these and other accessories provide, operations that would normally be achieved by moving the router or using a completely different woodworking tool are executed on a router table. An example is a dado. To further enhance the safety and utility provided by a router table, the overall size is increased. The design of a desirable router table must take into consideration the need to adjust the various router settings as well as access to the router to change cutters.

In designs where the router is attached directly to the table, using screws or clamps, the size of the table is limited by the need to access the router either from below or by lifting the entire table. In practice, the largest size that will enable needed access is less than that desirable for maximum safety and utility.

This problem is overcome by attaching the router to a plate that is then recessed into or attached to the peripheral table. This construction effectively solves the size problem but the separate surfaces of the plate and peripheral table introduce a discontinuity in the surface that often affects the utility of the router table. Thus the transition between these two surfaces must be selectively adjustable in order to ensure that work pieces traveling over the transition are unimpeded.

Many prior router tables achieve this adjustment by utilizing two sets of mechanical fasteners such as machine screws. The first set is used to lift the plate to the proper height, while the second set fixes the location by holding the plate down.

Other approaches use similar mechanical fasteners to increase the thickness of the plate which rests on a rim or ledge in the peripheral table surface. Other mechanical fasteners are used to hold the plate down.

A common element of these prior approaches is the inclusion of mechanical fasteners that affix the plate to the table surface at whatever height is set by other means. This, however, has the same shortcoming as attaching the router directly to the table. Prior approaches also hold the router table plate in position solely by gravity. While this allows the plate and router to be easily removed for adjustment or bit changes, it does not prevent vibration, nor can it compensate for slight distortion in the plate and or surrounding table material.

In use, a router attached to a plate in a router table can be accessed for adjustments or cutter changes by removing the router and plate assembly from the table surface, making any adjustments necessary and re-inserting the router and plate assembly.

Ideally, the transition between the plate and table surface is continuous, and the plate lacks any features that will allow a user to grip the plate in order to lift the router and plate assembly. It is thus necessary for the user to lift the router and plate from below the table surface. This operation can be difficult or impossible if the area below the table surface is used for other purposes or is closed off, such as for dust collection or storage.

It is thus desirable to provide a device that will allow a router and plate assembly to be lifted or partially lifted above a table surface from a location on the perimeter of the table surface.

Desirably, such a lifting device should be strong enough to provide the force required to lift a router and plate assembly free of whatever structure and force that secures the assembly in position for use.

SUMMARY OF THE INVENTION

This invention is a router table plate with router mounting clamps, a plate leveling system for securing and positioning the plate in the router table and a plate lift assembly. While the components of this system are usable separately, together they provide a particularly easy to use, highly functional router table apparatus.

Although the router table components of this invention can be used with a variety of router table plates, they function particularly well with a relatively large round steel plate. Such a plate should, preferably, be able to accept round plastic center-hole inserts of the type described in U.S. Pat. No. 5,715,880, which is incorporated herein by this reference.

Provision must be made for attaching a router to the plate, and it is preferable that the structure for doing so be able to accommodate a variety of different routers and that it be able to secure a particular router quickly, easily, repeatedly and without extensive adjustment each time it is attached.

A router table plate must be secured in a router table in an appropriate position flush with the surrounding table. It is desirable that adjustment be easily accomplished and that the plate, with or without router attached, be easily inserted and removed from the router table for adjustment of the depth of cut and other adjustments.

This invention achieves these and other objectives with router mounting clamps, plate levelers and a cam lifter further described below and in the accompanying drawings.

Plate Clamps

The router to plate mounting structure of this invention employs a clamping device that grips the router base. To be effective, the clamps must restrict the movement of the router in the three major axes. The clamps described here achieve this in two stages, first by fixing the location of the router base on the underside of the plate, and, second, by applying force so as to hold the router base against the underside of the plate to which the clamps are attached.

Locating the position of the router base on the underside of the plate is achieved by utilizing two or more clamp bases that contact the router base at a minimum of three positions. A polygon that connects the contact points will encompass the axis of the router cutter. An excellent clamp base is disclosed in U.S. Pat. No. 5,715,880.

The cross-sectional shape of router bases often includes a flat surface parallel to the bottom surface of the base. Clamping a router base with such geometry merely involves applying force along an axis normal to the surface, and this approach is utilized in U.S. Pat. No. 5,715,880. However, not all routers contain such a surface. On some router bases, the exposed surface is not parallel to the bottom surface of the router.

The clamping arms of this invention have been designed to securely clamp router bases with both parallel and non-parallel surfaces.

An arched clamping arm rests against each clamp base and against the router base. Each end of each clamping arm terminates in a foot. One foot contacts the base plate of the clamp, while the other contacts foot contacts a surface on the router base. Clamping force is achieved using a knurled nut on a threaded post that passes through a slot in the arm between the two contact points.

In order to accommodate the largest number of router bases, the slot that accepts the clamping post onto which the knurled nut is threaded permits the clamping arm to be positioned in a wide range of locations in order to optimize the clamping geometry. Additionally, the feet are two different lengths so that they terminate at different heights. This allows the clamps to be used in two different orientations to further optimize the clamping geometry.

Without structure preventing it, the slot might permit the clamp arms to slide along the clamping posts. This could conceivably permit the clamps to loosen unintentionally. To prevent this from occurring, the location of the arm relative to the clamping post is fixed when the clamps are engaged but adjustable when the clamps are released. This is accomplished by a series of grooves in the upper surface of the arm transverse to its length (and to the slot within which the post is received). These grooves receive one or more mating tabs on the underside of a washer on the clamping post under the knurled nut. When clamped together between the knurled nut and the router base, the washer tabs or protrusions engage one or two of the grooves and prevent the arm from sliding along the post.

Plate Levelers

In the plate levelers of this invention, an arm is affixed to the underside of the router table surface. A portion of the arm projects below the opening in the table within which the plate fits, and that projection is penetrated by a threaded hole configured to accept a screw. The lower end of the screw is knurled for adjustment by a user or includes features designed to accept a standard screwdriver, wrench or similar tool. The upper end of the screw is either ferro-magnetic or incorporates a magnet on which the plate rests. The plate is made from a material that is substantially ferro-magnetic, such as low carbon steel. Rotating the screw raises or lowers the portion of the plate resting on the magnet. This permits precise adjustment of the plate relative to the adjacent router table surface to achieve perfect alignment between the two.

A finer pitch thread will result in greater control over the adjustment of the surface position, and a courser pitch thread will enable more rapid vertical movement.

Utilizing magnetic coupling between the router table and the plate means that no mechanical fasteners are required to affix the plate to the table. As a result, removal of the plate does not require disassembly of a portion of the device. All that is required is sufficient force to exceed the attractive force provided by the magnets.

A router table used for small projects may require frequent removal of the plate and router from the table for adjustment and cutter changes. This can result in small rotational forces applied to the leveler and support screws. Such rotation, of course, will cause misalignment between the plate and the router table. A similar problem can result from vibration during use.

Such undesired rotation of the leveler screws can be prevented by incorporation of a means for preventing unintended rotation. For instance a second hole parallel to and partially intersecting the threaded hole in the support arm can receive a plug made from a substantially high friction and malleable material such as rubber. When inserted in the second hole, such a plug will bear against and resist rotation of the screw. The net force required to rotate the screw is thus substantially greater than the force that can be applied through accidental or unintentional means. However, the resistance caused by the plug does not exceed the force that can be applied by the fingers of a typical user.

Desirably, the second hole may have the shape of a cloverleaf. This shape includes four projections that compress the plug to increase the friction between the plug and the hole to prevent unintentional removal of the plug.

The arm supporting the adjustment screw could be part of the table structure rather than a separate component attached to the table structure, as long as support for the adjusting screw and structure for preventing its unintended rotation is provided.

When used to adjust the surface of a mounting plate relative to a router table, a minimum of three screws are required to provide the ability to adjust the position of a plate relative to its entire periphery. Typically such positioning screws should be substantially uniformly distributed around the circumferential edge of the plate. However, it is merely sufficient that a polygon connecting the contact points of these screws will encompass the axis of the router bit or cutter.

Plate Lift Assembly

In the cam lifter of this invention, a rod is mounted to the underside of the router table so that it can be rotated by a lever accessible by the user. The inner end of the rod remote from the handle extends beyond the edge of the hole in the router table within which the plate to which the router is attached is positioned. Attached to this end of the rod is a cam mounted in a substantially orthogonal manner. The shape of the cam is such that the uppermost edge moves vertically as the rod is rotated. Thus, by rotating the handle, the uppermost edge of the cam moves vertically, lifting the router table plate resting on or near the cam.

By adjusting the relative angle between the cam and handle, the device can be optimized for the circumstances in which it is used.

In one embodiment, the cam is a circular plate. The rod is mounted orthogonal to the cam through an axis that is not coaxial with the center axis of the cam. The cam includes a plurality of holes onto which a user may attach a different cam design. The rod of this embodiment is threaded rod and its length can vary depending upon the requirements. The rod could incorporate a plurality of cams in order to vary the manner in which a plate is lifted or the number of plates lifted at the same time.

DETAILED DESCRIPTION

Figure 1:
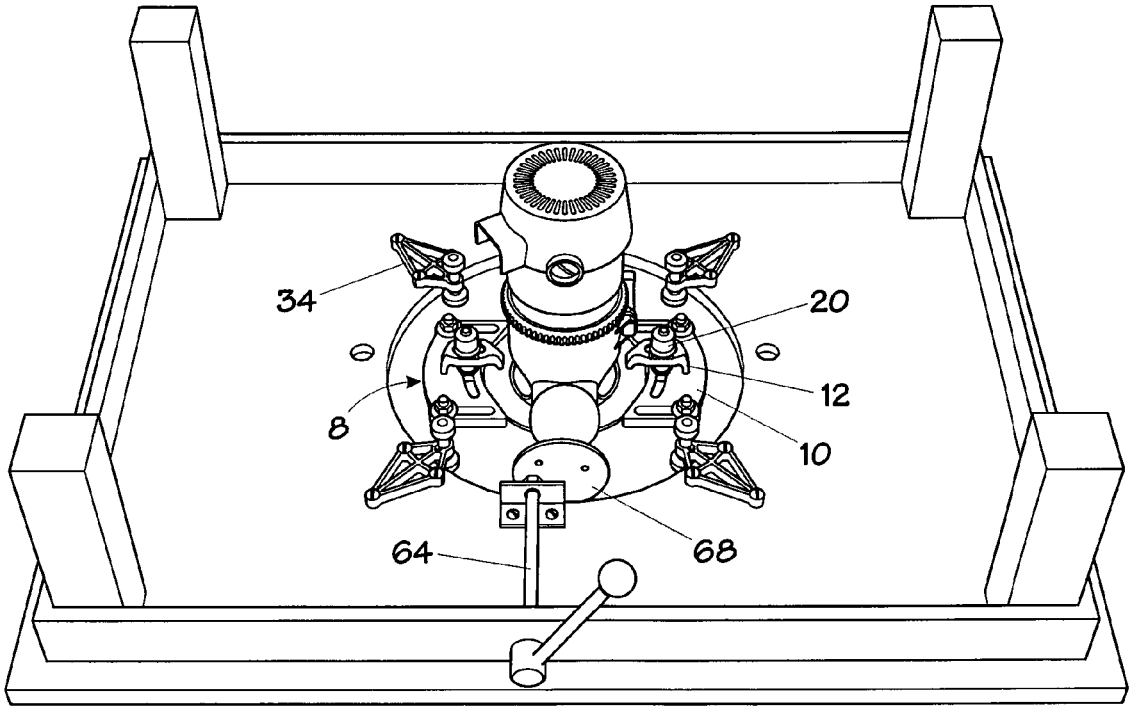
FIG. 1 is a perspective view of an assembled router table plate with router mounting clamps, plate leveling system for securing and positioning the plate in the router table and plate lift assembly of this invention.

An illustrative embodiment of this invention is shown in FIG. 1 as a router table plate with router mounting clamps, a plate leveling system for securing and positioning the plate in the router table and a plate lift assembly.

Figure 2:
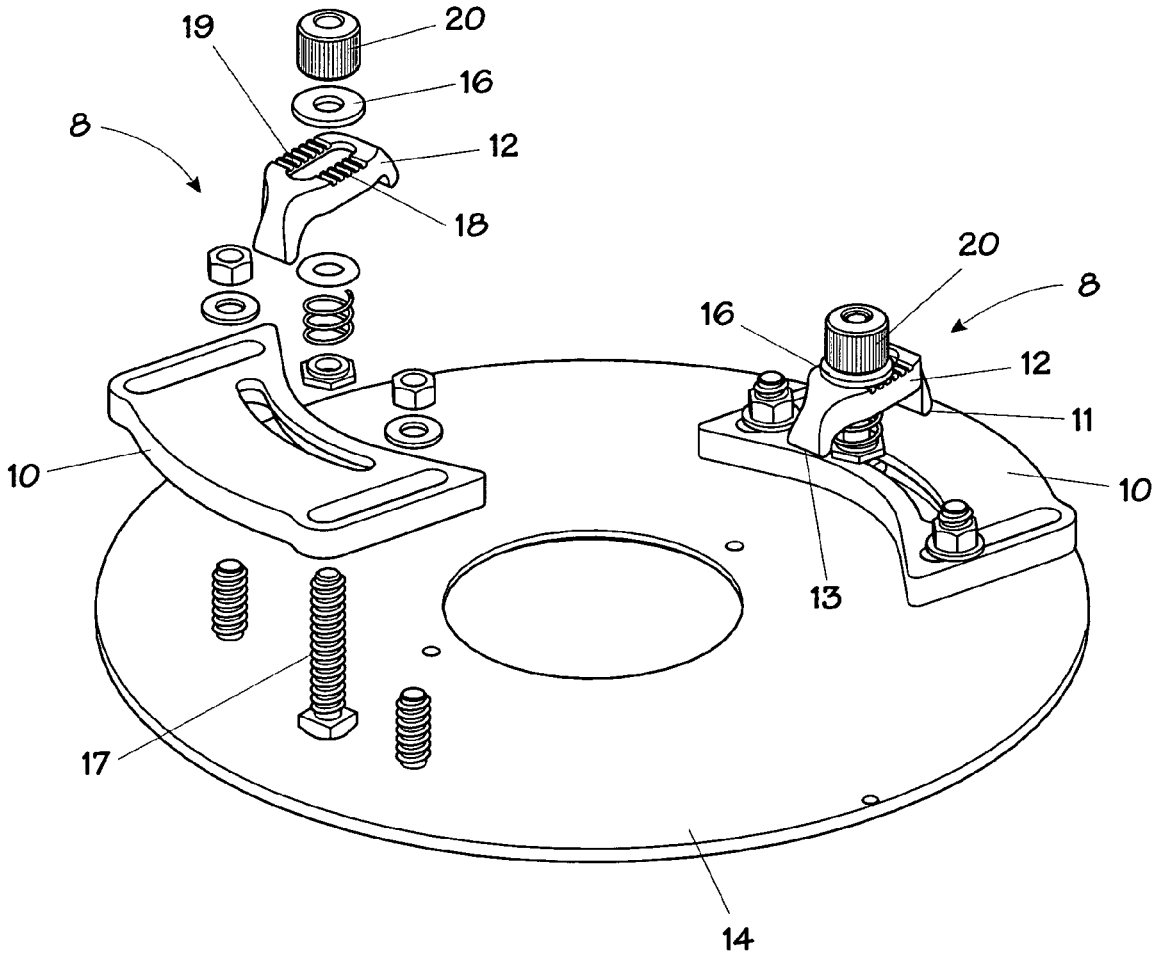
FIG. 2 is a perspective view of a plate and plate clamps of this invention, the plate clamps shown in an exploded perspective view on the left side and in an assembled view on the right side.
Figure 3:
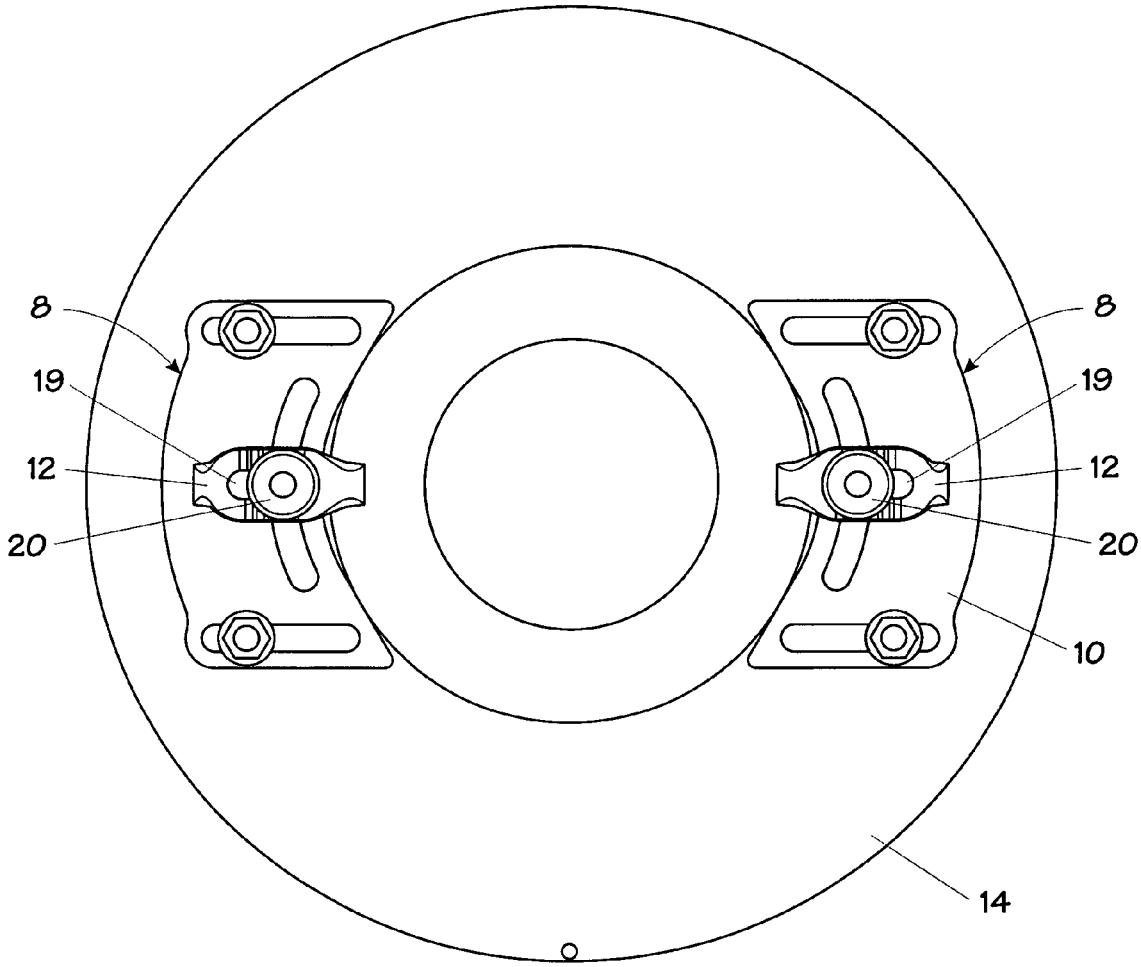
FIG. 3 is a bottom view of the plate and clamps of FIG. 1, shown assembled.
Figure 4:
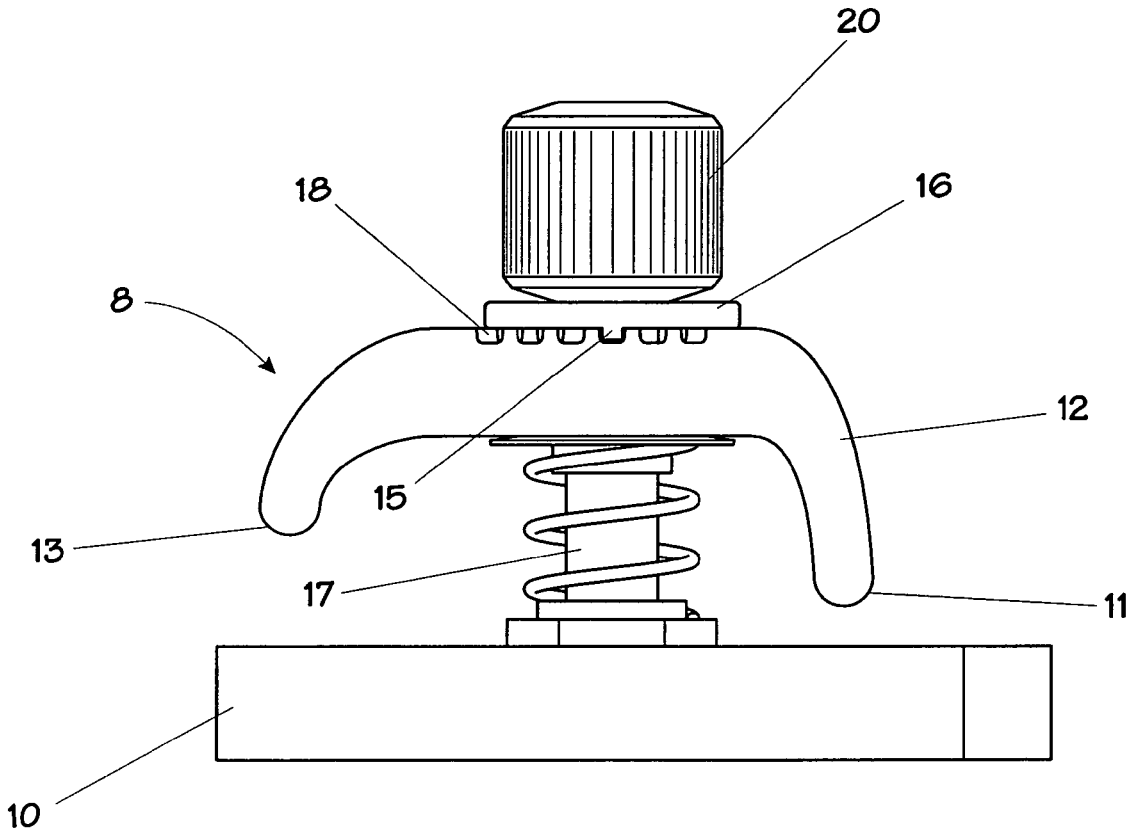
FIG. 4 is a side view of a clamp of FIG. 1.
Figure 5:
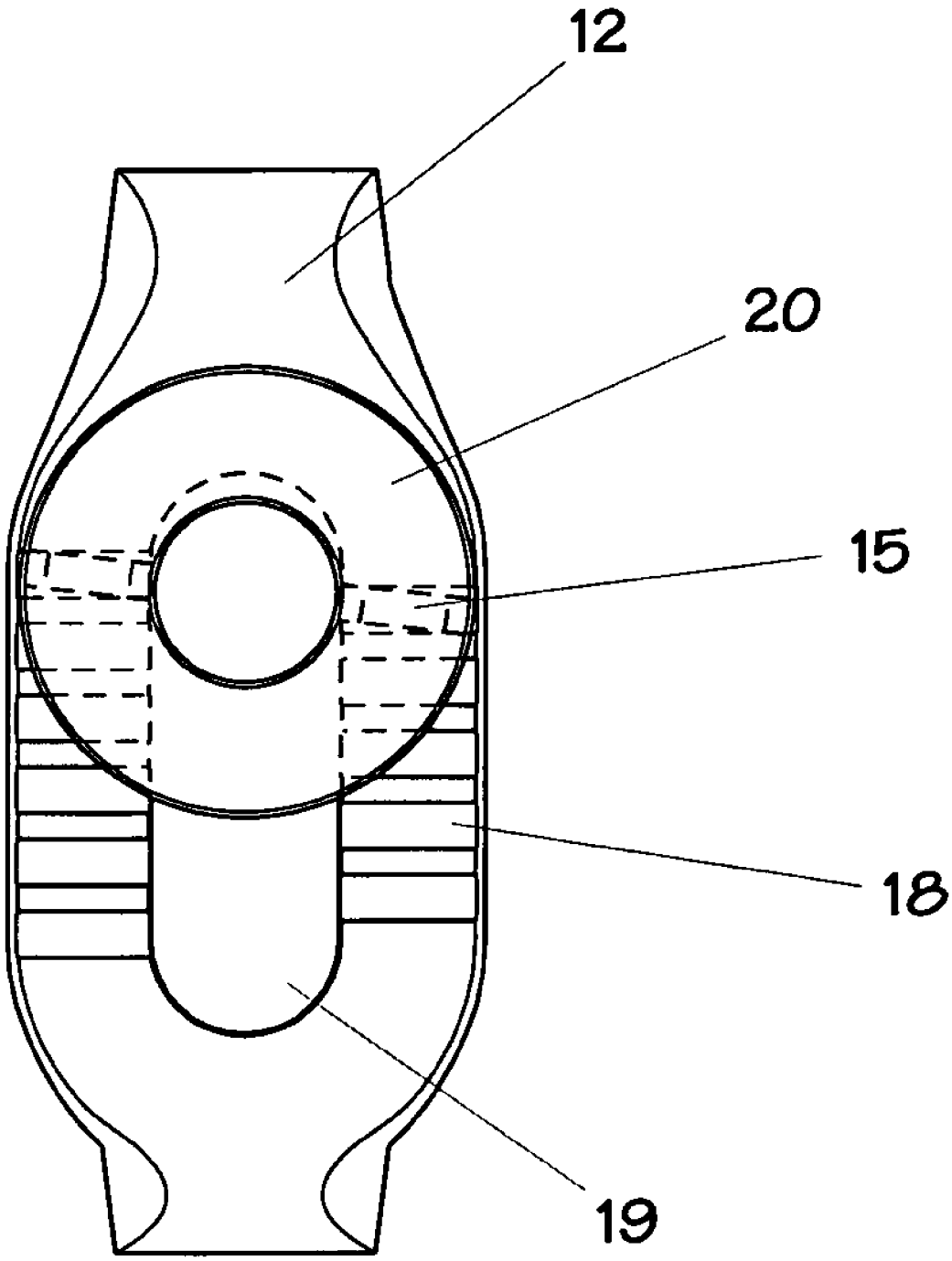
FIG. 5 is a top view in partial cross-section of a clamp of FIG. 1.
Figure 6:
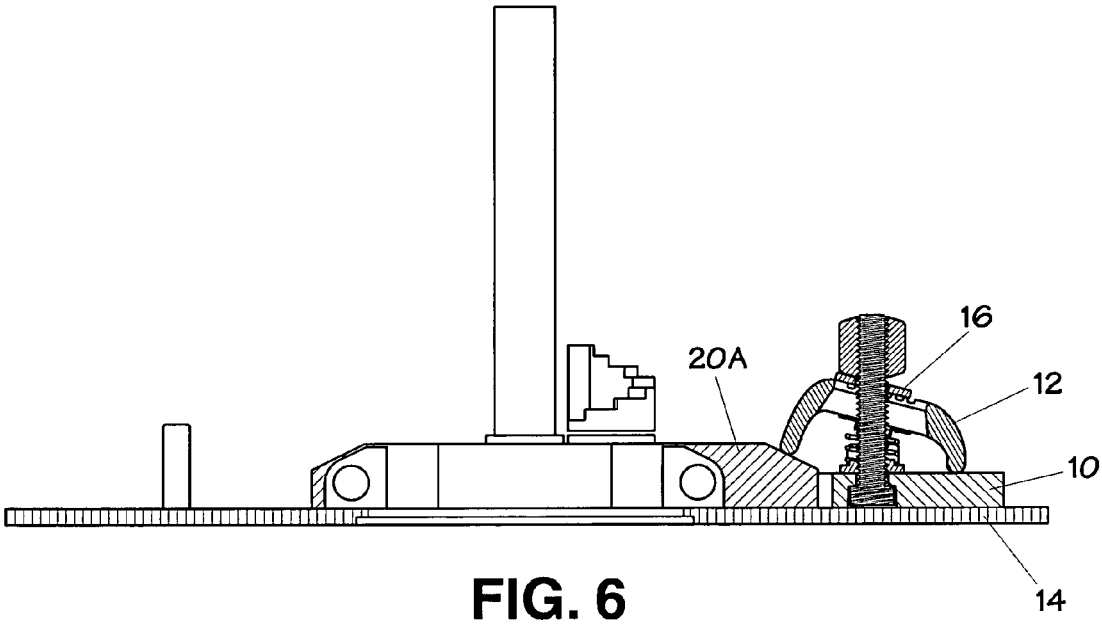
FIGS. 6-9 are side views in partial cross-section of the plate and clamps of FIG. 1, showing various of the arm securing routers having various bases to the plate.
Figure 7:
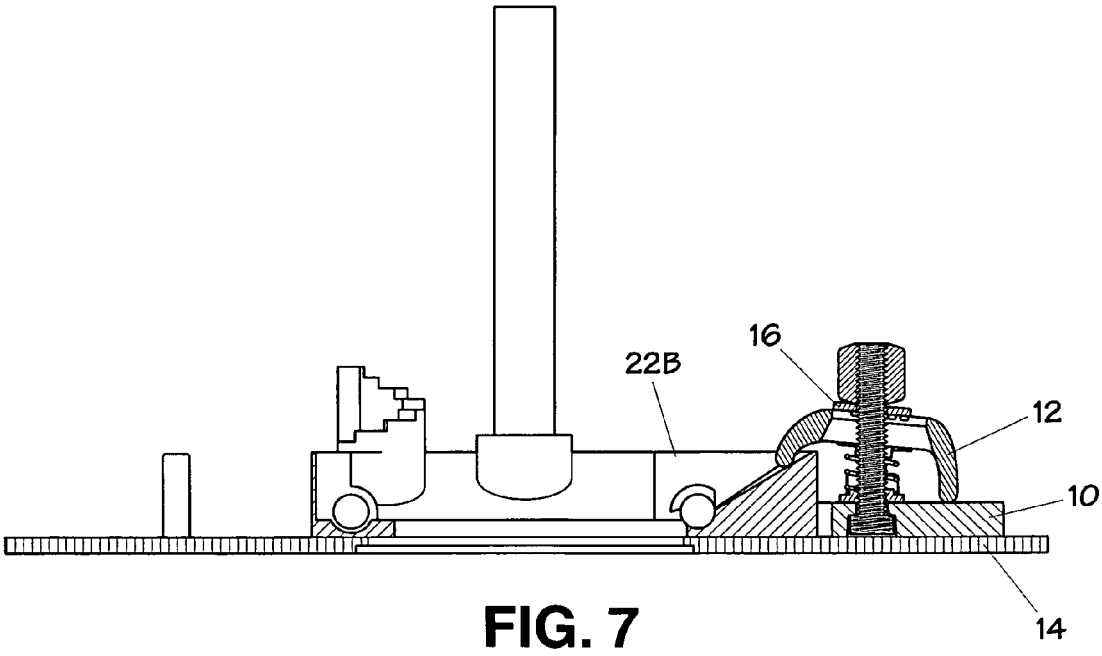
Figure 8:
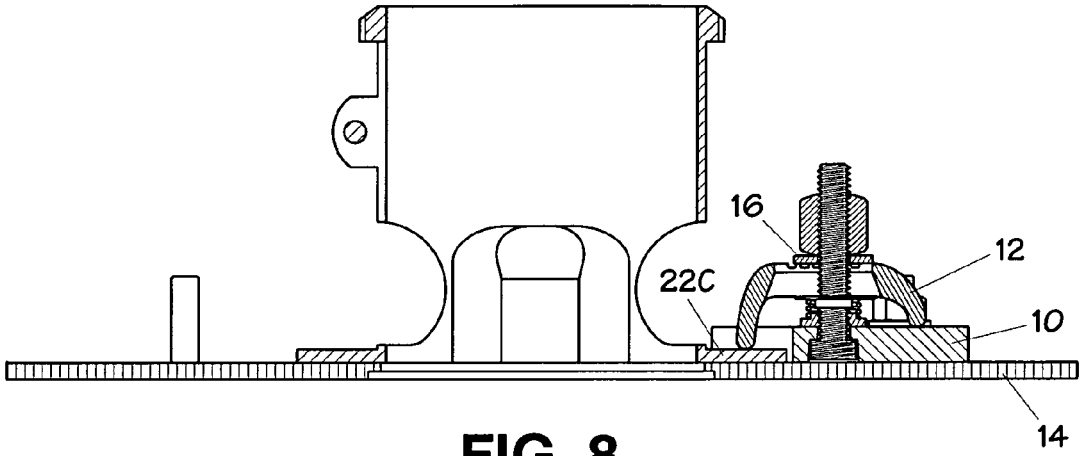
Figure 9:
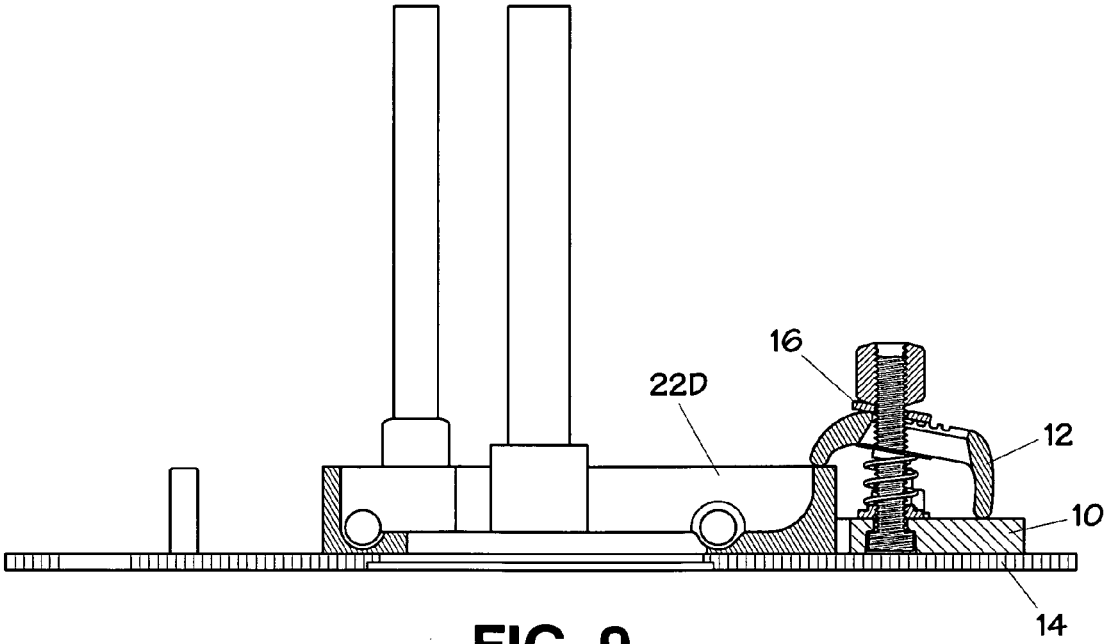

The components of the plate clamps 8 of this invention are shown assembled on the right side and exploded on the left side of FIG. 2. Each clamp 8 includes a clamp base 10 secured to the plate 14 and an arm 12 for securing the router (not shown in FIG. 2) to the plate 14. Washer 16, having one or more groove-engaging protrusions or tabs 15 (shown in FIGS. 4 and 5) engages at least one of the grooves 18 on arm 12 to prevent any risk that arm 12 will move after knurled nut 20 is tightened. FIG. 3 is a bottom view of the plate 14 and clamps 8. Tabs 15 are visible in both the side view of FIG. 4 and the top view of FIG. 5.

Arched clamping arm 12 rests against each clamp base 10 and against the router base (not visible in FIG. 2). Each end of the clamping arm 12 terminates in a foot portion 11, 13. A first foot 11 contacts the base plate of the clamp 10. A second foot 13 contacts the surface of the router base. Knurled nut 20 on threaded post 17 passes through slot 19 in arm 12 between the two feet, thereby achieving a clamping force.

In order to accommodate the largest number of router bases, slot 19 permits clamping arm 12 to be positioned in a wide range of locations in order to optimize the clamping geometry. FIGS. 6-9 show various orientations of arm 12 securing routers having various bases 22A, 22B, 22C or 22D to the plate 14. Additionally, the feet 11, 13 are two different lengths so that they terminate at different heights, allowing the clamps to be used in two different orientations.

To prevent sliding of clamp arm 12 in slot 19, the location of the arm 12 relative to the clamping post 17 is fixed when the clamps 8 are engaged but adjustable when the clamps 8 are released. A series of grooves 18 in the upper surface of the arm 12 transverse to its length (and to the slot within which the post is received) receive one or more mating tabs 15 on the underside of washer 16 on the clamping post 17 under the knurled nut 20. When clamped together between the knurled nut 20 and the router base, the washer tabs 15 engage one or two of the grooves 18 and prevent the arm 12 from sliding along the post 17.

Figure 10:
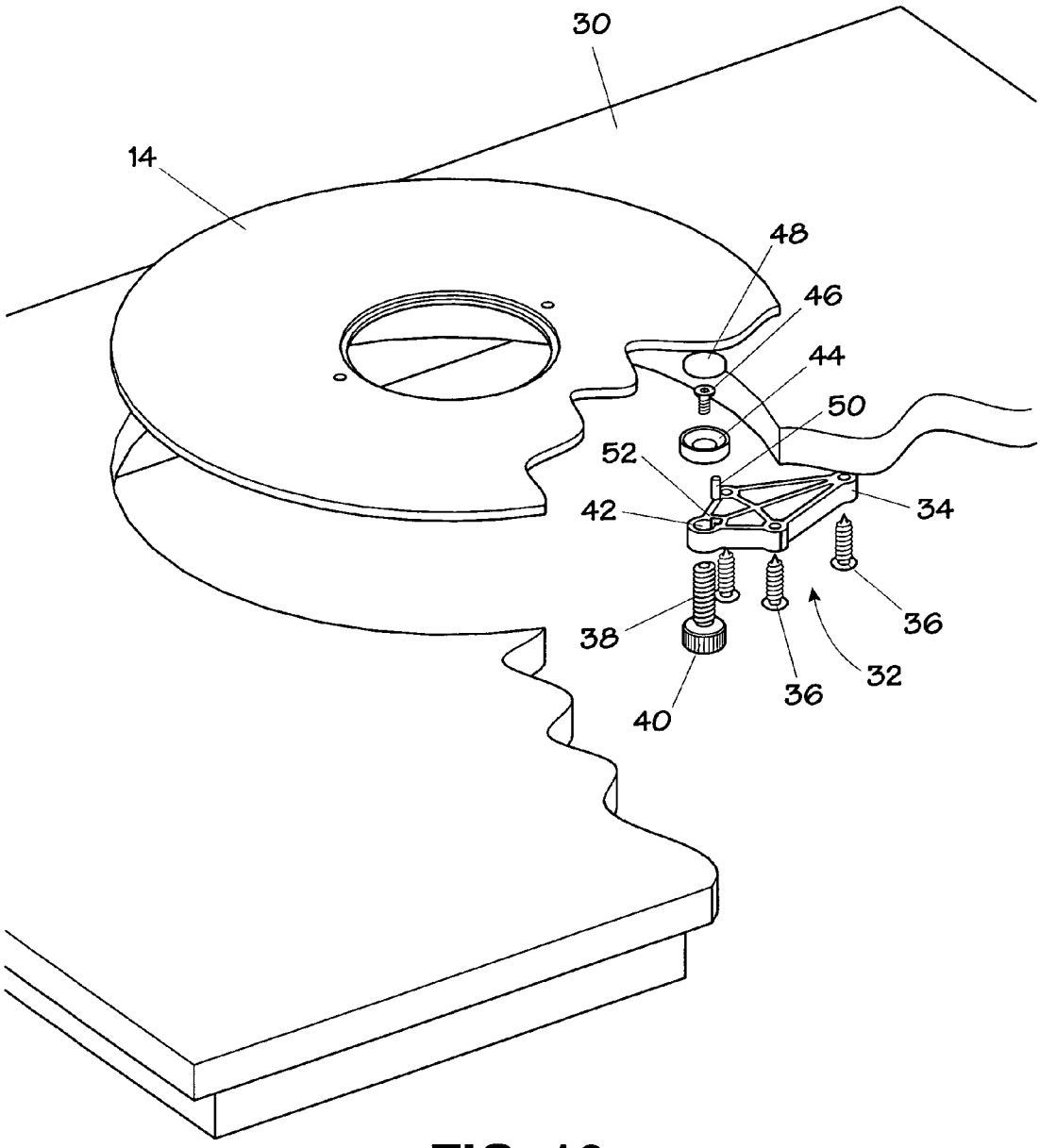
FIG. 10 is an exploded perspective view, with parts of a router table and plate broken away to facilitate showing components of one of the plate levelers of this invention.
Figure 11:
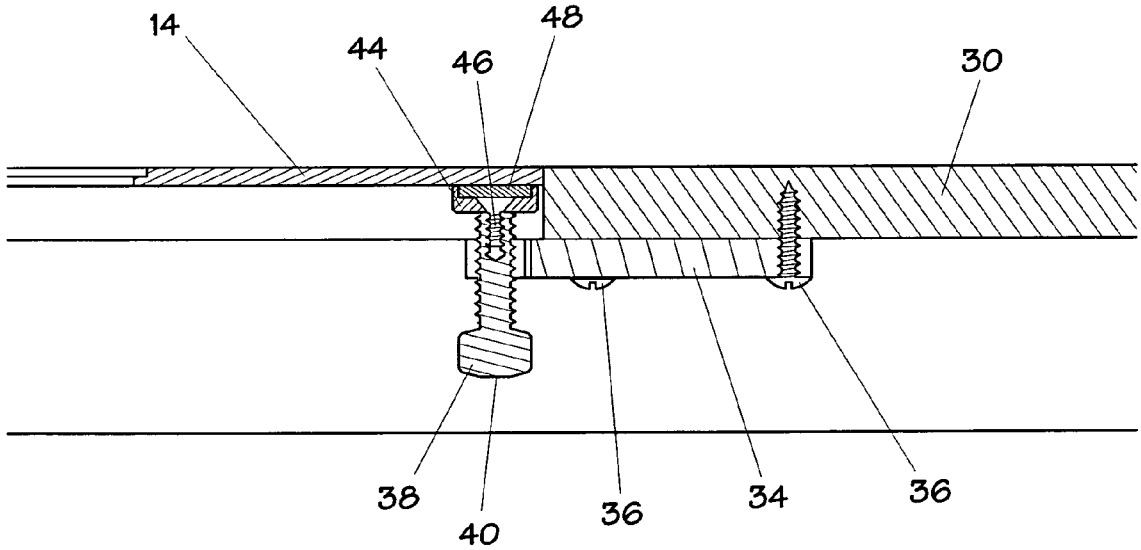
FIG. 11 is a side view in partial cross-section of the plate leveler of FIG. 10.

FIG. 10 is an exploded perspective view, with parts of the router table 30 and plate 14 broken away to facilitate showing the components of one of the plate levelers 32. As shown in FIG. 10 and in the side cross-sectional view of FIG. 11, in each leveler 32 a support arm 34 is secured to the underside of the table 30, which can be done, for instance, with screws 36. Leveler screw 38, which may have a knurled head 40, is threaded through hole 42 in support arm 34. A magnet cup 44 is secured to the end of leveler screw 38 with a screw 46, and a rare earth magnet 48 is positioned in cup 44 and held there by attraction between the cup 44 and magnet 48. Plate 14 rests on magnet 48 and or the upper rim of magnet cup 44, and the height of plate 14 relative to the top of table 30 is adjustable by rotating screw 40. As described, above a plug 50 positioned in hole 52 adjacent to threaded hole 42 prevents unintended rotation of screw 38. Arm 34 may be manufactured from extruded aluminum, or any other suitable material.

Figure 12:
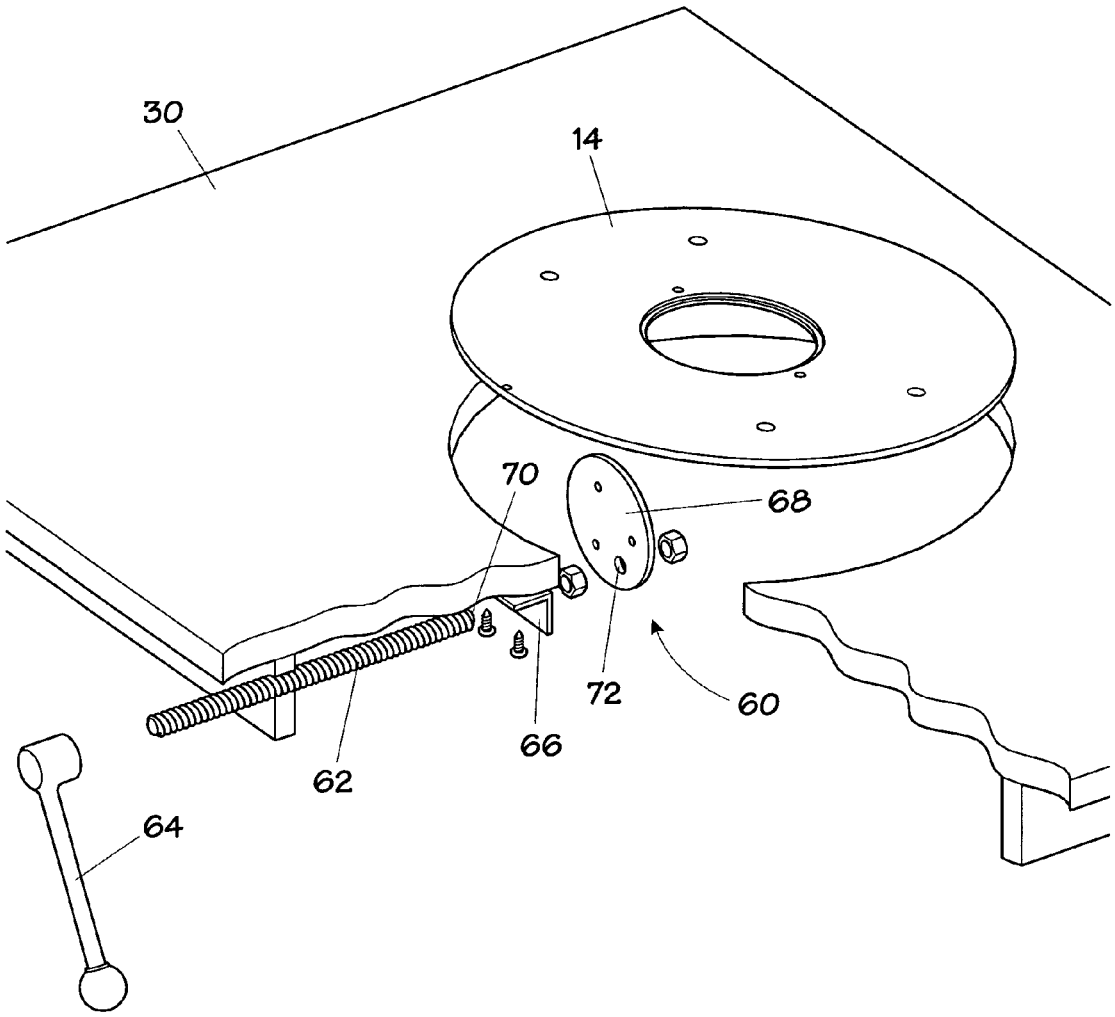
FIG. 12 is an exploded perspective view of the components of a plate lift assembly of this invention.
Figure 13:
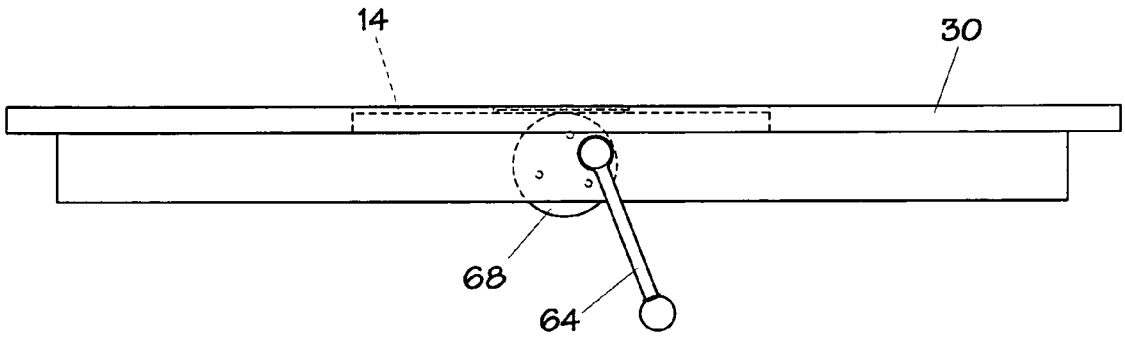
FIG. 13 is a side view in partial cross section of the plate lift assembly of FIG. 12.
Figure 14:
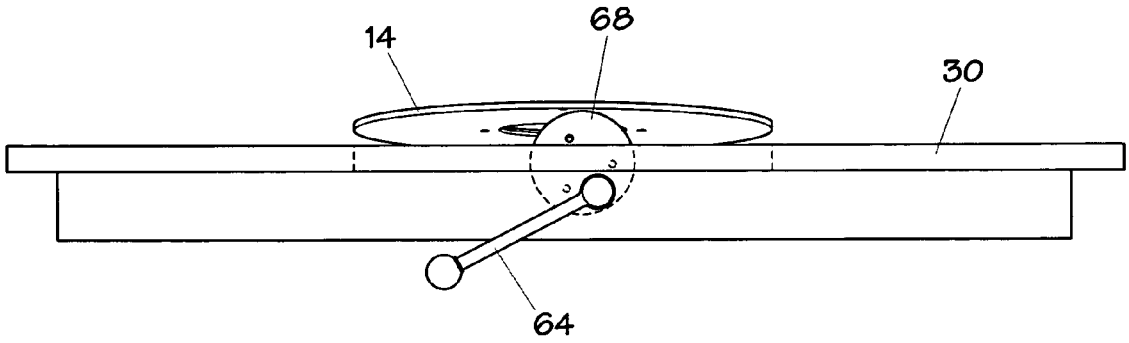
FIG. 14 is a perspective view of the plate lift assembly of FIG. 12.

FIG. 12 is an exploded view of the components of a plate lift assembly. Cam lifter 60 includes rod 62 rotated by lever handle 64. Rod 62 passes through a guide 66 adjacent to the edge of the opening in table 30 within which the plate 14 is located. Cam 68 is attached to the end of rod 62 remote from handle 64 by receiving rod 62 end 70 in a non-centered hole 72 in cam 68. As may be easily appreciated by comparison of FIGS. 13 and 14, rotation of lever handle 64 rotates cam 68, thereby lifting an edge of plate 14 with sufficient force to overcome the attraction between plate 14 and magnets 48 (where used).

As noted above, the router table components of this invention function particularly well with some of the components described in U.S. Pat. No. 5,715,880, and incorporated by reference above. For example, in one embodiment, a router base plate of this invention has a relatively large diameter hole, on the order of 3.75 inches in diameter, below which the router is centered. Inserts are locked in position within this hole. The perimeter of the round inserts has an upper circular portion of a particular diameter and a lower circular portion sufficiently smaller in diameter to provide a downward-facing ledge. The smaller diameter portion of the insert is circular but is not concentric with the larger diameter portion; instead, the two are offset by a small amount on the order of approximately 0.015 inch.

Likewise, the bores in the plates are formed with an upper, larger diameter portion and a lower, smaller diameter portion, each of which bore corresponds generally to the respective diameter of the upper and lower portions of the insert. The bores on the plates likewise are not concentric but are offset by an amount approximately equal to the offset in the inserts. In one example, the first bore is a stopped, larger diameter bore approximately, for example, 3⅞ inches in diameter that penetrates one-half of the thickness of the plate. The second is a smaller diameter bore, for example, 3⅝ inches in diameter, that penetrates the portion of the plate not penetrated by the first bore and which is offset from the first bore by, for example, 0.015 inch.

Inserts are locked in position by placing the insert within the bores in the plate with the respective upper and lower portions of the insert and plate bores concentric. The insert is then rotated relative to the plate so that the cam-like action resulting from the nonconcentricities locks the insert in place. In one example, the insert is a plastic plate equal to or slightly smaller in thickness than the thickness of the plate. This thickness may, for instance, be approximately 3/16 inch. Each insert has an edge defined by larger and smaller diameter rims. The larger diameter rim is circular and is sized to fit snugly within the larger bore in the plate. For example, the rim may be approximately 1/64 inch smaller in diameter than the larger bore. The smaller diameter rim is sized to fit snugly within the smaller bore and is offset from concentricity with larger rim by approximately the same small amount as the offset between the bores. Note that the offset centers combine with the two contact surfaces to create a camming action for holding the insert in place within the plate.

The insert may be made of super-high-impact polystyrene, polycarbonate, or other similar plastic, and thickness of the insert should be carefully controlled so that there is in no event any projection of the insert above the top side of the plate. Inserts may be rotated for securing them in position or removal with the heel of one's hand or with a tool having two pins that are received in holes in the insert. Such a tool may be a disk of wood approximately the same diameter as the inserts from which disk pins protrude with appropriate spacing to be received in the holes.

The router table assembly of this invention is not confined to the embodiments described herein but includes variations and modifications within the scope and spirit of the foregoing description, the accompanying drawings and the following claims.

The invention claimed is:

1. A router table, comprising:

(a) a ferro-magnetic base plate having a top side and an underside, (b) at least one clamp attached to the underside of the base plate for securing the base plate to a router, (c) a router table top having a top surface for receiving the base plate within an opening in the table top so that the base plate top side is generally flush with the top surface of the table top, (d) at least one leveler attached to the table top and for engaging the base plate magnetically and adjusting the position of the base plate top side relative to the top surface of the table top; and (e) a lift attached to the table top for lifting at least a portion of the base plate above the top surface of the router table top wherein the lift further comprises a cam coupled to the router table top and in contact with the base plate wherein rotation of the cam moves at least a portion of the plate relative to the table.

2. The router table of claim 1, wherein the lift further comprises a lever for rotating the cam, and a shaft coupling the lever to the cam.

* * * * *